United States Patent [19]

van der Toorn

[11] Patent Number: 4,480,627

[45] Date of Patent: Nov. 6, 1984

[54] DEVICE FOR DEMOLISHING CONCRETE PILES

[75] Inventor: Aart van der Toorn, Voorburg, Netherlands

[73] Assignee: Persluchtcentrale Nederland B.V., Leiden, Netherlands

[21] Appl. No.: 396,300

[22] Filed: Jul. 8, 1982

[51] Int. Cl.³ ..... B28D 1/32

[52] U.S. Cl. ..... 125/23 R; 30/92

[58] Field of Search ..... 125/1, 13, 14, 23; 30/92

[56] References Cited

U.S. PATENT DOCUMENTS

| | | | |
|---|---|---|---|
| 2,912,969 | 11/1959 | Masson | 125/23 C |
| 3,056,267 | 10/1962 | McRee | 30/92 |
| 3,559,631 | 2/1971 | Mangis | 125/23 C |
| 3,998,201 | 12/1976 | Miural | 125/23 R |
| 4,044,749 | 8/1977 | Bowen | 125/23 R |
| 4,124,015 | 11/1978 | Isaksson | 125/23 R |
| 4,197,828 | 4/1980 | Schellhorn | 125/23 C |

FOREIGN PATENT DOCUMENTS

| | | | |
|---|---|---|---|
| 2074491 | 11/1981 | United Kingdom | 30/92 |

*Primary Examiner*—Harold D. Whitehead

*Attorney, Agent, or Firm*—Hubbard, Thurman, Turner & Tucker

[57] ABSTRACT

A device for breaking up concrete piles comprising a housing bounding a passage and having two relatively parallel plates, to which are secured supports extending between them, to which supports are fastened hydraulic rams each having a piston rod, to the end of which is fastened a chisel which can be displaced through the passage with the aid of the hydraulic ram concerned, the chisels being passed through openings matching the cross-sections of the chisels and provided in screening plates bounding the passage and extending between the relatively parallel plates.

8 Claims, 4 Drawing Figures

DEVICE FOR DEMOLISHING CONCRETE PILES

The present invention relates to a device for breaking up concrete piles.

In practice it is often necessary to break up the top ends of concrete piles driven into the ground in order to arrange the top ends of the piles finally staying in the ground all at the same desired level.

Hitherto it has been common practice to break off the top ends of the piles with the aid of pneumatically operating demolishing hammers or the like, sometimes termed head-hunting. Breaking off the top ends of piles with the aid of pneumatic demolishing hammers is a labour-intensive operation causing great sound nuisance and, in addition, it adversely affects the operator's health. For many years there has been great need for a device with the aid of which concrete piles can be broken off whilst avoiding the disadvantages inherent in the method hitherto employed.

According to the invention this can be achieved by means of a device for breaking off concrete piles comprising a housing bounding a passage and having two relatively parallel plates, between which supports are fastened, to which supports are fastened hydraulic rams each having a piston rod, to the end of which is secured a chisel displaceable in the passage with the aid of the hydraulic ram concerned, said chisels being passed through openings, the diameter of which matches that of the chisels, said openings being provided in screening plates bounding the passage and being located between the relatively parallel plates.

In this way a simple and rugged device can be obtained, which can be slipped onto the pile to be worked in a manner such that the end of the pile to be broken off is located in the passage, after which by actuating the hydraulic rams the chisels can penetrate into the concrete of the pile for cracking the same.

Moreover, an advantageous, uniform power transfer from the rams to the two relatively parallel plates can be ensured via the supports secured to said plates so that the device may have a light-weight structure.

The invention will be described more fully hereinafter with reference to an embodiment of a device in accordance with the invention schematically shown in the accompanying Figures.

Figure 1:
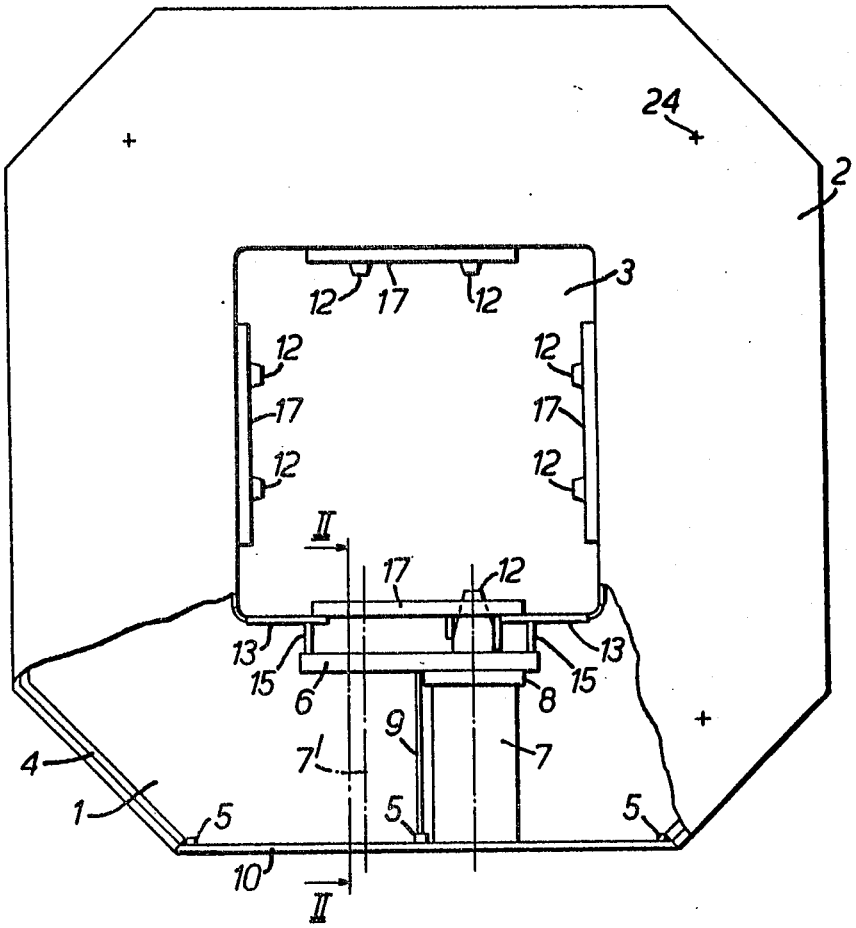
FIG. 1 is a schematic plan view of a device embodying the invention, part of the upper one of the two relatively parallel plates being omitted.
Figure 2:
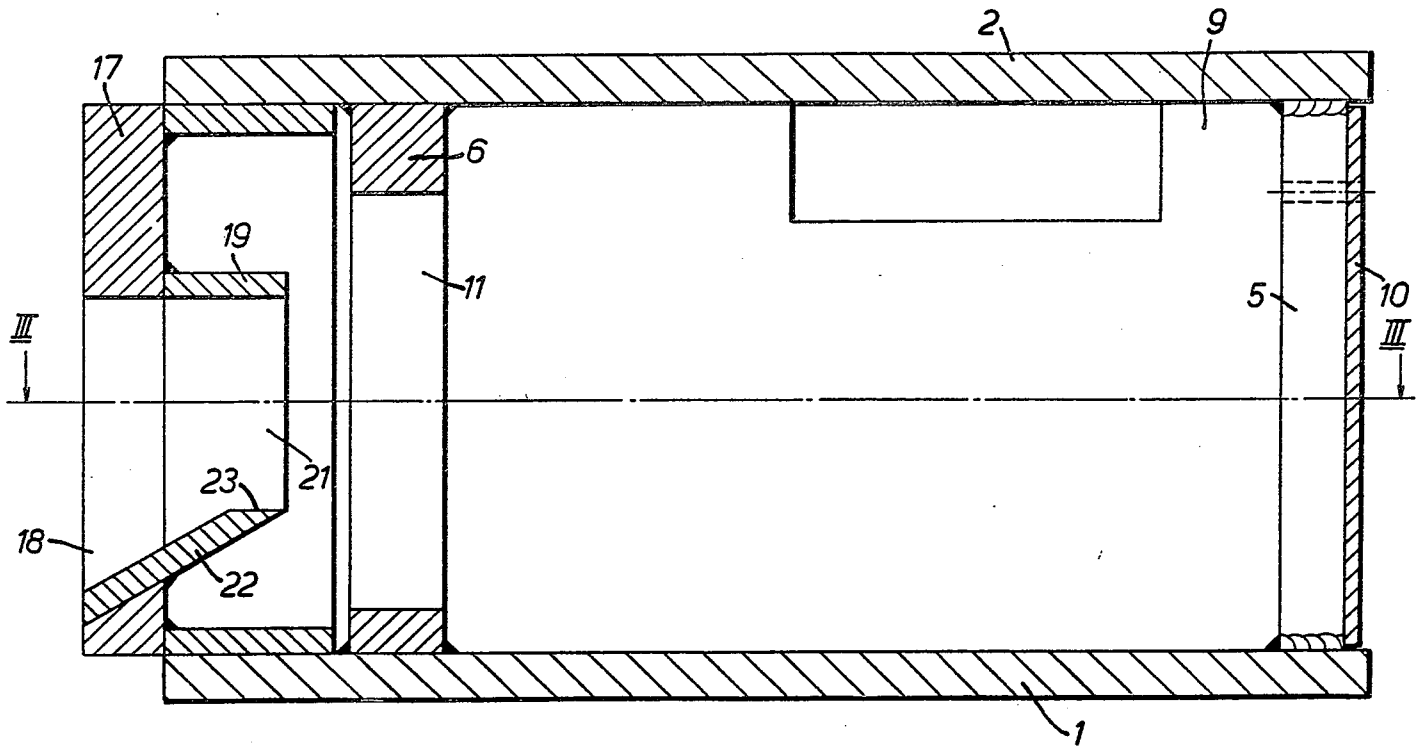
FIG. 2 is an enlarged cross-sectional view taken on the line II—II in FIG. 1.

The device illustrated in the Figures comprises two relatively parallel plates 1 and 2, each of which has a central opening 3, which superjacent, registering openings form a passage.

Near the outer periphery, which is octagonal in the embodiment shown, the plates 1 and 2 are connected with four tie plates 4 extending between said plates. Moreover, near the outer periphery of the plates vertical tie strips 5 are arranged between the outer edges of the plates extending parallel to the boundary edges of the openings 3.

Between the plates 1 and 2 are furthermore arranged four tie plates 6, which, like the tie members 4 and 5, are welded to the proximal sides of the plates 1 and 2. Each tie plate 6 extends parallel to a boundary edge of the square opening 3 and is located internally of the plates 1 and 2 at a given distance from the boundary edge concerned, as will be seen in FIG. 1. Each tie plate 6 serves to support two hydraulically operating rams 7, only one of which is shown in FIG. 1 with the associated tie plate 6 and the other hydraulic ram fastened to said tie plate 6 is indicated only by its centre line 7'. From FIG. 1 it will be apparent that the hydraulic ram is disposed on the side of the ram supporting plate 6 remote from the passage 3 and it is secured to said plate with the aid of a flange 8 arranged near one end of the ram.

The connection between the ram supporting plate 6 and the plates 1 and 2 is reinforced with the aid of a stiffening plate 9 extending between the middle of the plate 6 and a tie strip 5 and being welded to the plate 6 as well as to the plates 1,2 and to the tie strip 5.

In order to bound the space between the plates 1 and 2 boundary plates 10 located between the plates 4 can be screwed to the outer sides of the tie strips 5.

Figure 3:
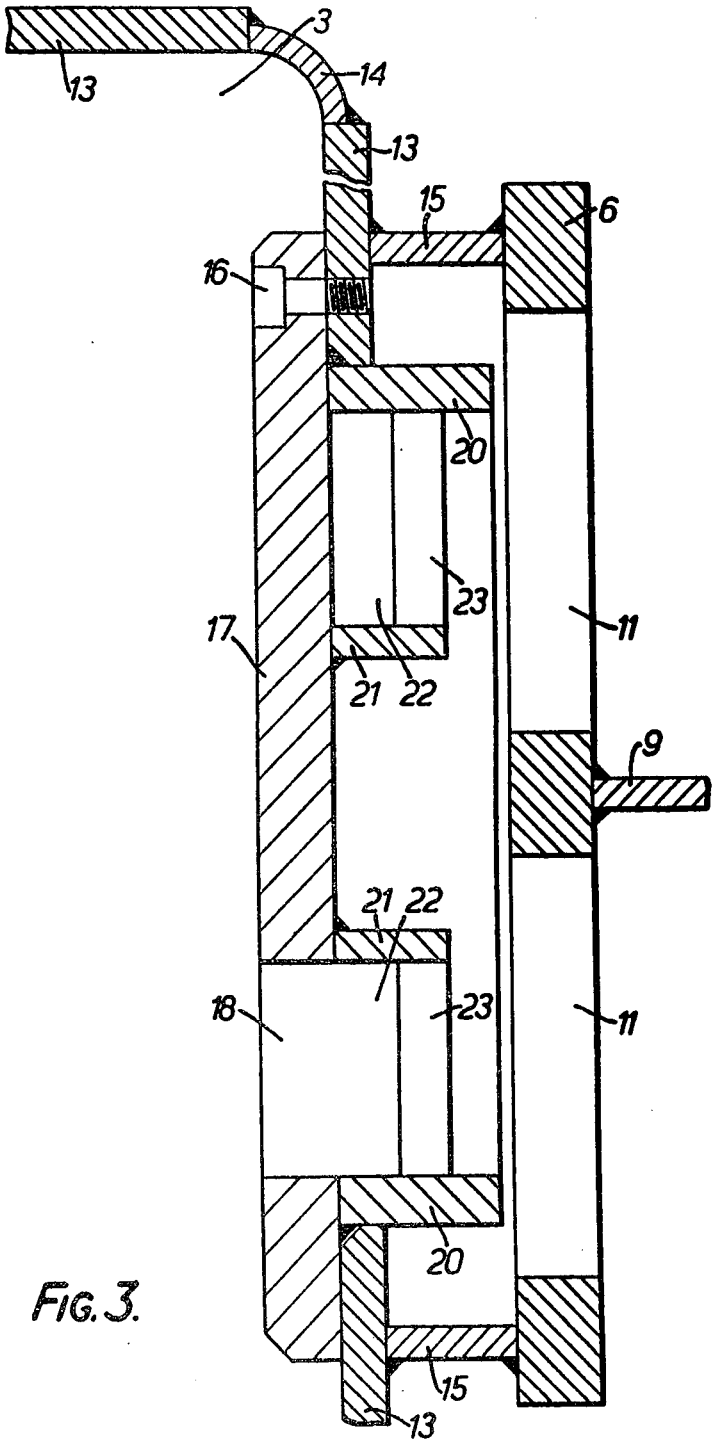
FIG. 3 is a sectional view taken on the line III—III in FIG. 2.

FIG. 3 shows that at the level of the two rams 7 fastened to a supporting plate 6 holes 11 are provided in the plate 6 for passing the ends of the piston rods emerging from the rams 7. In the embodiment shown non-circular section chisels 12 are fastened to the ends of said piston rods.

From FIGS. 1 and 3 it will be apparent that near the corners of the openings 3 tie plates 13 are welded between the plates 1 and 2, said tie plates being interconnected at the corners by curved tie plates 14. Between the relatively parallel plates 6 and 13 are arranged tie strips 15, which are also welded to the proximal sides of the plates 1 and 2.

On the sides of every two co-planar plates 13 facing the passage 3 screening plates 17 are fastened with the aid of bolts 16. At the level of the openings 11 each screening plate 17 has openings 18. On the side of the plate 17 facing the plate 6 a horizontal, rearwardly extending plate 19 adjoins the upper edge of the opening 18. At the distal vertical boundary edges of the two openings 18 plates 20 extending towards the plate 16 adjoin the rear side of the plate 17 and the edges of the plates 13 (FIG. 3) for limiting a lateral movement of the plate 17. Plates 21 extending parallel to the plates 20 adjoin the other vertical edges of the openings 18. The lower edge of the opening 18 has a plate 22 upwardly inclined at an angle of about 30°, the upper edge 23 of said plate being bevelled so that the upper edge 23 is parallel to the plate 19. Thus the plates 19, 20 and 21 and the upper edge 23 of the plate 22 define an opening, the cross-section of which corresponds with the cross-section of the end of the chisel 12 adjoining the piston rod of the ram 7 so that the chisel 12 is guarded against a turn about the centre line of the ram 7.

The device can be slipped, for example, onto the top end of a concrete pile driven into the ground so that this top end of the pile extends through the passage 3. By subsequently supplying pressurized fluid through ducts (not shown) connected with the hydraulic rams 7 the chisels 12 can be caused to reciprocate and thus to penetrate into the concrete of the pile, the concrete being thus cracked and broken off from any reinforcement provided in the pile.

By the mode of fastening described above of the plates 6 carrying the rams in the housing of the device an effective transfer of the forces exerted by the rams on the plates 1 and 2 is obtained whilst a rugged construction is obtained of fairly light weight.

By using the disengageable plate 17 with the guide plates 19 to 22 fastened thereto for the chisels not only the chisels are guarded against rotation, but also concrete grit is prevented from penetrating up to the rams. The inclined lower walls of the passages accommodating the chisels are conducive to a satisfactory evacuation of loosened concrete grit and the like.

Moreover, the plates 19 to 23 are capable of absorbing forces exerted transversely of the direction of length of a chisel so that such forces are not transferred to the ram.

In order to facilitate manipulation of the device the top plate 2 may be provided at four points 24 with hoisting eyelets so that the device can be suspended to a crane or the like.

Figure 4:
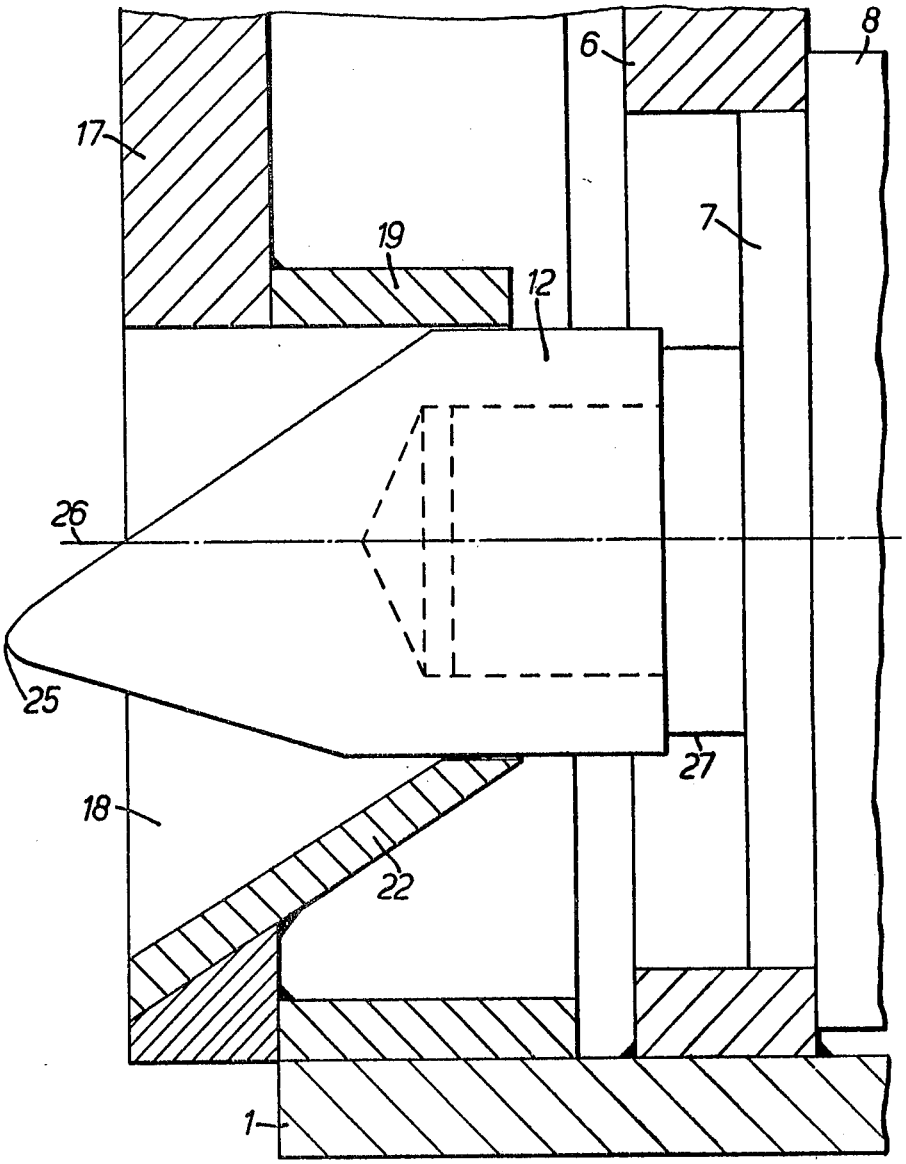
FIG. 4 shows one embodiment of a chisel on an enlarged scale.

FIG. 4 shows a particularly advantageous embodiment of a chisel.

From this Figure it will be apparent that the tip or cutting edge 25 of the non-circular chisel is eccentric to the centre line 26 of the piston rod 27 of the ram 7. As stated above, the chisel 12 is guarded against a turn during operation. If it is found that, when breaking up the concrete of a reinforced concrete pile, the tip of the chisel 12 touches a reinforcement bar and is, therefore, no longer capable of effectively breaking up the concrete, it is possible, after removal of the plate 17 concerned, to turn the chisel through 90° or 180° so that the tip 25 is displaced and will pass by the reinforcement bar after the plate 17 is re-arranged and the device is re-actuated. In order to adapt the size of the passage 3 to the cross-section of the pile to be worked, the screening plates 17 can be moved nearer the middle of the opening by arranging filling pieces between the plates 17 and the plates 13. The lengths of the chisels can be adapted, if necessary, by exchanging chisels.

As a matter of course, variations and/or additions to the construction described above are possible within the spirit and scope of the invention.

A device intended to work circular-section piles may, for example, be constructed with a circular passage 3, in which case the hydraulic rams can be arranged radially to the centre of the passage.

To a support may be fastened only one or more than two rams. A further possibility is to dispose the rams in off-set positions in a direction of height so that the chisels can pass one another in crossing paths, which may be advantageous for breaking up piles of small cross-sections.

In order to break up piles over a large height in a single run, several devices of the kind described above can be stacked up. For this purpose holes can be provided one above the other in the plates 1 and 2 at appropriate areas, between which holes sleeves can be welded between the plates 1 and 2.

When several devices are thus stacked up, pull rods can be passed through said sleeves so that the stacked devices can be clamped to one another by means of said pull rods.

In such a combination the lowermost chisels can be set so that the cutting edges of these chisels are parallel to the plane at right angles to the longitudinal axis of the pile, whereas the cutting edges of the further chisels are arranged parallel to the longitudinal axis of the pile.

Although in the embodiment described above a chisel is used, whose end adjoining the piston rod has a non-circular, particularly square cross-section, it will be obvious that a circular-section chisel may also be employed. If these chisels also have elongate cutting edges, it may be desirable to provide wedges to prevent the chisels from turning.

I claim:

1. A device for breaking-up concrete piles comprising a housing having two relatively parallel plates with central holes defining a passage for a concrete pile together with screening plates mounted between said parallel plates and in front of supporting plates connecting the parallel plates near said holes, the members interconnecting said parallel plates near the outer circumference of said parallel plates, hydraulic rams each being fixed with one end to a supporting plate, chisels displaceable by said rams in the longitudinal direction of said rams towards and away from a pile located in said passage in directions being at an angle to each other, the chisels being passed through openings in said screening plates matching the cross-sections of the chisels.

2. A device as claimed in claim 1 wherein said supporting plates extend parallel to the boundary edges of the passage are arranged around the rectangular passage between the relatively parallel plates, each supporting plate having two hydraulic rams fasted to it.

3. A device as claimed in claim 2 wherein a strut plate is arranged between the rams and fastened both to the supporting plate and relatively parallel plates.

4. A device as claimed in claim 1 wherein the passage is bounded by four screening plates, each having two openings for passing the chisels.

5. A device as claimed in claim 1 wherein at least one chisel is provided with a tip located eccentrically to the centre line of the hydraulic ram displacing said at least one chisel and can be turned about said centre line.

6. A device as claimed in claim 1 wherein the chisels have a non-circular cross-section.

7. A device as claimed in claim 1 wherein the hydraulic rams are disposed in relative off-set positions in a direction of height.

8. A device as claimed in claim 1 wherein in order to bound an opening through which a chisel is passed the screening plate has fastened to it plates surrounding the top side and the lateral sides of the chisel, whilst the chisel is suppported on the underside by the upper edge of a plate fastened to the screening plate and being downwardly inclined away from the chisel towards the passage.

* * * * *